United States Patent [19]

Tomiyama et al.

[11] Patent Number: 4,551,410

[45] Date of Patent: Nov. 5, 1985

[54] PHOTOGRAPHIC ELEMENT FOR COLOR DIFFUSION TRANSFER WITH TWO NEUTRALIZING LAYERS

[75] Inventors: Hideki Tomiyama; Masaki Satake, both of Kanagawa, Japan

[73] Assignee: Fuji Photo Film Co., Ltd., Kanagawa, Japan

[21] Appl. No.: 631,113

[22] Filed: Jul. 16, 1984

[30] Foreign Application Priority Data

Jul. 14, 1983 [JP] Japan ..... 58-128224

[51] Int. Cl.[4] ..... G03C 5/54; G03C 1/40

[52] U.S. Cl. ..... 430/215; 430/216; 430/237

[58] Field of Search ..... 430/216, 237, 454, 428, 430/215

[56] References Cited

U.S. PATENT DOCUMENTS 3,734,727 5/1973 Milligan ..... 430/216

4,323,644 4/1982 Nakamura et al. ..... 430/216

4,356,249 10/1982 Abel et al. ..... 430/216

FOREIGN PATENT DOCUMENTS

WO80/02333 10/1980 PCT Int'l Appl. ..... 430/216

*Primary Examiner*—Richard L. Schilling

*Attorney, Agent, or Firm*—Sughrue, Mion, Zinn, Macpeak, and Seas

[57] ABSTRACT

In a color diffusion transfer photographic element, a novel neutralization system for reducing the pH of an alkaline processing solution comprises at least two steps wherein the first step pH of the processing solution is reduced to a range in which development and dye release reactions are substantially discontinued but in which diffusion of dyes for forming transfer images continues, and in the second step pH is further reduced and allows to reduce at a neutralization rate lower than the rate in the first step to a final pH of which the transfer image formed is stable upon storage for a long period.

23 Claims, 1 Drawing Figure

PHOTOGRAPHIC ELEMENT FOR COLOR DIFFUSION TRANSFER WITH TWO NEUTRALIZING LAYERS

FIELD OF THE INVENTION

The present invention relates to a photographic element for color diffusion transfer processing and, more particularly to a photographic element for color diffusion transfer processing (DTR color) in which neutralization of a processing solution by a neutralization system is effected in two steps.

BACKGROUND OF THE INVENTION

It is known both in photographic elements for conventional photographic processing and diffusion transfer photographic processing to provide a temporary barrier layer among layers into which processing compositions permeate. Particularly in diffusion transfer photographic processing, a neutralizing layer is employed for purposes such as stopping development, stabilizing images, etc. It is well known to use a temporary barrier layer for purposes of "timing" neutralization, i.e., to prevent reduction of the maximum density due to premature neutralization of a developing solution by this neutralizing layer. The temporary barrier layer used for such purposes is called a timing layer and is disclosed in, for example, U.S. Pat. Nos. 4,061,496, 4,056,394 and 4,201,587; Japanese Patent Application (OPI) Nos. 72,622/78 and 141644/82 (corresponding to U.S. Pat. No. 4,199,362) (as used herein the term "OPI" refers to a "published, unexamined Japanese Patent Application").

In silver halide photography development is generally slow at low temperatures and rapid at high temperatures. In the case of instant photography employing diffusion transfer processing, development is conducted at various temperatures, and not at controlled temperatures as in conventional photography. In order to obtain good images even at varied development temperatures, it is extremely important for photographic elements to be able to compensate for temperature in neutralization of a processing solution, such that neutralization is rapidly completed at high temperatures because development rapidly proceeds at high temperatures, but, that neutralization is prolonged at low temperatures because development proceeds slowly. In the patents and patent applications cited above, many timing layers are disclosed which have the function of compensating for temperature.

Conventional mono-sheet diffusion transfer photography processes have the disadvantage that density of the image generally increases, in maximum density areas, gradation areas and minimum density areas, to seriously decrease image quality with the passage of time (from several days to several weeks after the formation of images). This phenomenon is referred to as "post-transfer", and occurs because the dyes released (liberated) during processing do not all immediately move to a mordanting layer, but partially remain in layers other than the mordanting layer. With the passage of time, these remaining dyes are gradually transferred into the mordanting layer. Cover sheets having timing layers as disclosed in the patents and patent applications cited do not have any function of preventing such post-transfer.

U.S. Pat. No. 4,356,249 teaches that a first timing layer and a second timing layer may be provided as timing layers (provided that the temperature coefficient is negative for the first timing layer), along with a conventional neutralizing layer, and an auxiliary neutralizing layer is provided between the first timing layer and the second timing layer to thereby improve processing temperature dependency of a color diffusion transfer photographic film unit (assemblage) containing a positive type redox compound as a dye image forming compound. In this photographic system which improves processing temperature dependency, the auxiliary neutralizing layer is designed so as to control the degree of release of a dye from a positive type redox compound caused by development of silver halide at low temperatures on a markedly higher level than that at high temperatures. However, this photographic system does not present post-transfer, since the system does not intend to prevent post-transfer of the diffusible dye released from the positive type redox compound.

SUMMARY OF THE INVENTION

Accordingly, an object of the present invention is to provide a photographic element for color diffusion transfer comprising a novel neutralization timing system which prevents post-transfer without deteriorating the sharpness of transferred images.

As a result of extensive investigations, the present inventors have discovered that post-transfer can effectively be prevented by a photographic element for color diffusion transfer comprising a two-step neutralization system for reducing the pH of an alkaline processing solution.

A neutralization timing layer has hitherto been employed in a conventional film unit in order to control the neutralization in two principal respects. First, there is a purpose of neutralizing the alkalinity due to an alkaline processing solution spread in the film unit by an acidic polymer layer. A second purpose of neutralization is that the development is stopped and the release of a dye from a dye-providing compound is stopped, as well as that the pH in the film unit (in particular an image-receiving layer) is reduced to 7 or less to stabilize the dye images. In other words, in a conventional film unit a neutralization timing layer having the above two purposes was carried out by a single neutralization timing layer. Accordingly, the "post-transfer" problem in the conventional film unit was caused by that the stopping of both the development and the release of dye from the dye-providing compound was not satisfactory and that the diffusion of the released dye did not proceed smoothly because the neutralization timing was conducted in a single stage.

On the other hand, in accordance with the present invention, the neutralization timing is conducted in two stages, relating to the two purposes for which the neutralization is carried out, whereby "post-transfer" can be effectively prevented.

In the present invention this neutralization system comprises a neutralizing layer and a timing layer provided directly or indirectly on or beneath the neutralizing layer in such a relation that the alkaline processing solution reaches the neutralizing layer through the timing layer, and neutralization of the processing solution in this neutralization system is divided into two steps, and further the progress of the neutralization in the first step is different from the progress of neutralization in the second step.

DETAILED DESCRIPTION OF THE PREFERRED EMBODIMENTS

Figure 1:
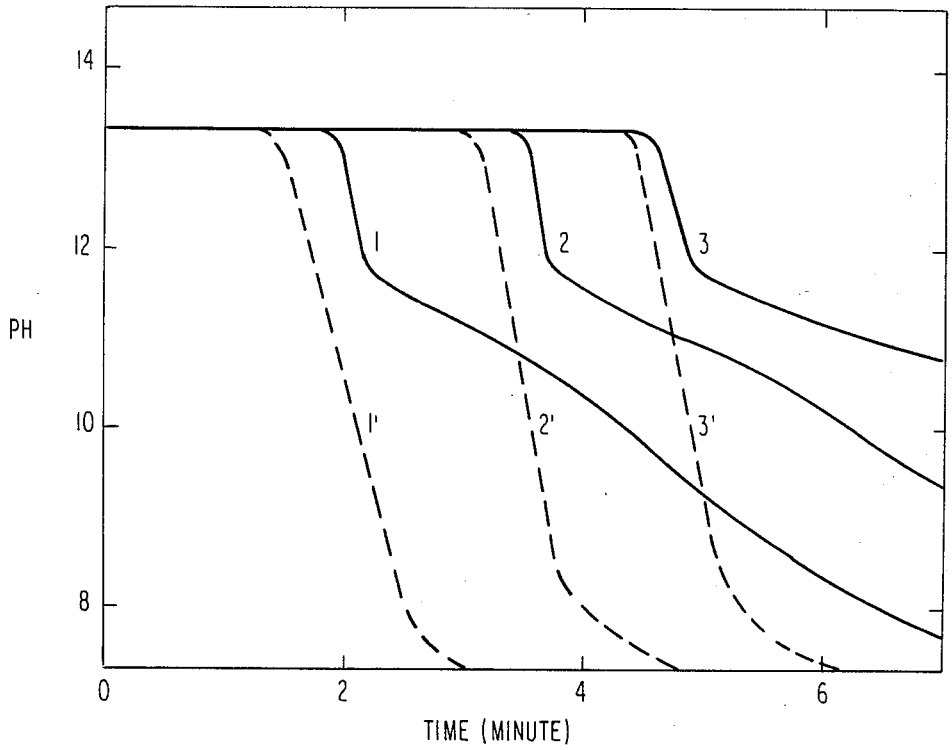
FIG. 1 is a graph of pH in a photographic system plotted against time, wherein numerals 1 to 3 and 1' to 3' indicate pH of Cover Sheets 1 to 3 of the present invention used in Example 1 and of Cover Sheets 1' to 3' for comparison, respectively. From the FIGURE, it is clear that pH changes occur in two steps with all of Cover Sheets 1 to 3 of the present invention.

In greater detail, in the photographic element of the present invention neutralization proceeds in at least two steps, in such a manner that the pH of an alkaline processing solution (in the photographic system) is reduced in a first step to a range in which development and dye release are discontinued, but the released dyes are continued to diffuse in order to form a transferred dye image and in a second step, the pH of the processing solution (in the photographic system) is more gradually reduced to a final pH that can withstand preservation over long periods of time. More specifically, the reduction of the pH in the first step is suitably from 14 to about 10, preferably from 14 to about 12, and that in the second step is suitably from about 10 to about 5, preferably from about 12 to about 7.

In a preferred embodiment, neutralization in the first step results in a sudden decrease in pH after a high pH has been maintained for a certain period of time—resulting in a characteristic "inverse S shape" graph of pH change. However, the present invention is not limited to this embodiment only. Namely, even though the first step does not proceed in the inverse S shape graph, the post-transfer can effectively be prevented. On the other hand, the characteristic feature of the neutralization process in the second stop is a relatively slow rate of pH reduction as compared with the first step, although "inverse S shape" pH change may also be acceptable. Such a two step neutralization process can be accomplished by a layer structure for neutralization system comprising, for example, a support having coated thereon, in succession, a neutralization layer, a second timing layer, an auxiliary neutralizing layer and a first timing layer. In the case of using a neutralizing layer for performing neutralization gradually, the neutralization process can also be realized by a layer structure for neutralization system comprising a support having provided thereon, in succession, a neutralizing layer, an auxiliary neutralizing layer and a first timing layer, omitting a second timing layer.

The mode of pH reduction can be freely controlled, in particular by varying the component, composition, coated amount, etc. of the aforementioned timing layers. In particular, it is possible to control the first period in which pH is maintained at a high level by the first timing layer; the pH reduction in the first step by the auxiliary neutralizing layer; and the mode of pH reduction in the second step by the second timing layer; and the neutralizing layer, respectively. By appropriately controlling the neutralization mode post-transfer can effectively be prevented. It is preferred that the first timing layer has a positive temperature coefficient, i.e., that time of development varies inversely with temperature and that neutralization be retarded at low temperatures.

As polymers in the first and second timing layers, both latex polymers and solvent-soluble polymers can be used; of these, solvent-soluble polymers are preferred. Homopolymers and copolymers are both acceptable, with copolymers being preferred. As polymers for the first timing layer, polymers represented by the following general formula (I) which are novel are preferred:

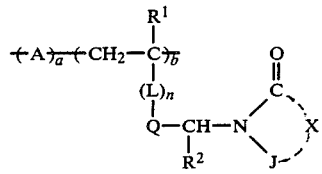

(I)

wherein A represents a monomer unit derived from a monomer containing at least one copolymerizable ethylenically unsaturated group; and $R^1$, $R^2$, L, Q, X, J, a, b, and n are defined later.

The ethylenically unsaturated monomer units A in preferred polymers of general formula (I) are derived from copolymerizable ethylenically unsaturated monomers, for example, ethylene; propylene; 1-butene; isobutene; styrene; chloromethylstyrene; hydroxymethylstyrene; sodium vinylbenzenesulfonate; sodium vinylbenzylsulfonate; N,N,N-trimethyl-N-vinylbenzylammonium chloride; N,N-dimethyl-N-benzyl-N-vinylbenzylammonium chloride; α-methylstyrene; vinyltolune; 4-vinylpyridine; 2-vinylpyridine; benzylvinylpyridinium chloride; N-vinylacetamide; N-vinylpyrrolidone; 1-vinyl-2-methylimidazole; monoethylenically unsaturated esters of fatty acids (e.g., vinyl acetate and allyl acetate); ethylenically unsaturated monocarboxylic acids or dicarboxylic acids or salts thereof (e.g., acrylic acid, methacrylic acid, itaconic acid, maleic acid, sodium acrylate, potassium acrylate, and sodium methacrylate); maleic anhydride; esters of ethylenically unsaturated monocarboxylic acids or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium p-toluenesulfonate, N,N-diethyl-N-methyl-N-methacryloyloxyethylammonium p-toluenesulfonate, dimethyl itaconate, and maleic acid monobenzyl ester); or amides of ethylenically unsaturated monocarboxylic acids or dicarboxylic acids (e.g., acrylamide, N,N,-dimethylacrylamide, N-methylolacrylamide, N-(N,N-dimethylaminopropyl-)acrylamide, N,N,N-trimethyl-N-(N-acryloylpropyl-)ammonium p-toluenesulfonate, sodium 2-acrylamido-2-methylpropanesulfonate, acryloylmorpholine, methacrylamide, N,N-dimethyl-N'-acryloylpropanediamine-propionate betaine, N,N-dimethyl-N'-methacryloylpropanediamineacetate betaine).

A may be freely selected from copolymerizable ethylenically unsaturated monomers. A may contain two or more monomer units and in this embodiment is useful for controlling permeability and solubility of alkaline processing compositions. In selecting polymers for the timing layers, in order to increase the high pH maintaining time provided by the temporary barrier, hydrophobic monomer units (for example, styrene, methyl methacrylate, butyl acrylate, etc.) are preferably used as A, or a combination of hydrophobic monomer units and hydrophilic monomer units may be used when two or more monomer units are used for A, however in this embodiment, the proportion of the hydrophobic monomer unit should be increased.

Further, when the polymer represented by general formula (I) is a cross-linked latex, monomers having at least two copolymerizable ethylenically unsaturated groups (for example, divinylbenzenne, methylenebisacrylamide, ethylene glycol diacrylate, trimethylene glycol diacrylate, ethylene glycol dimethacrylate, trimethylene glycol dimethacrylate, neopentyl glycol dimethacrylate, etc.) are employed as A, in addition to the aforesaid ethylenically unsaturated monomers.

J prepresents

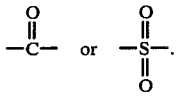

X represents an atomic group necessary to complete, together with

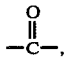

N and J at least one 5-membered or 6-membered heterocyclic ring which may be further substituted and which may be a fused ring system.

Of the heterocyclic structure represented by

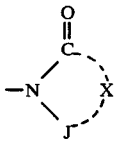

in formula (I), the following compounds are preferred:

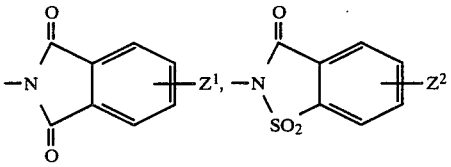

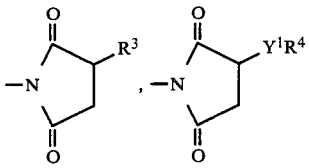

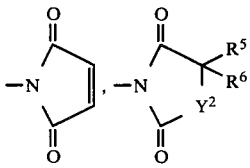

-continued

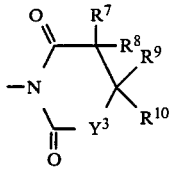

wherein $Y^1$, $Y^2$ and $Y^3$ may be the same or different, and each represents —O—, —S— or —N($R^{11}$)—; $Z^1$ and $Z^2$ may be the same or different, and each represents a hydrogen atom, a chlorine atom, a bromine atom, a nitro group, a carbamoyl group, a sulfamoyl group, an alkoxy group having preferably 1 to 4 carbon atoms (e.g., a methoxy group, a butoxy group, etc.), an alkyl group having preferably 1 to 6 carbon atoms (e.g., a methyl group, an isopropyl group, etc.), an aryl group having preferably 6 to 12 carbon atoms (e.g., a phenyl group, etc.) or an aralkyl group having preferably 7 to 12 carbon atoms (e.g., a benzyl group, etc.); $R^3$ to $R^{11}$ may be the same or different, and each represents a hydrogen atom, an alkyl group having preferably 1 to 6 carbon atoms (e.g., a methyl group, an isopropyl group, etc.), an aryl group having preferably 6 to 12 carbon atoms (e.g., a phenyl group, etc.), or an aralkyl group having preferably 7 to 12 carbon atoms (e.g., a benzyl group, etc.).

Q represents

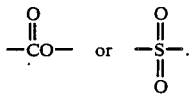

L represents a divalent organic group. Preferred examples of divalent organic group L are shown below, but the divalent linking group is not limited thereto, and may be selected from divalent linking groups known in the art.

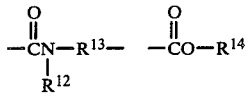

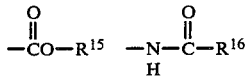

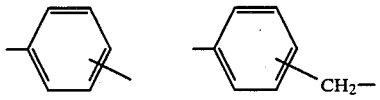

wherein $R^{12}$ represents a hydrogen atom, an alkyl group having 1 to 6 carbon atoms (e.g., a methyl group, an isopropyl group, etc.), an aryl group having 6 to 12 carbon atoms (e.g., a phenyl group, etc.), or an aralkyl group having 7 to 12 carbon atoms (e.g., a benzyl group, etc.); and $R^{13}$ to $R^{16}$ may be the same or different, and each represents an alkylene group having 1 to 6 carbon atoms (e.g., a methylene group, a dimethylmethylene group, an isobutylene group, etc.) or a phenylene group.

n represents 0 or 1.

$R^1$ represents a hydrogen atom or a methyl group.

$R^2$ represents a hydrogen atom, an alkyl group having preferably 1 to 6 carbon atoms, or an aryl group having preferably 6 to 12 carbon atoms. Of these, a hydrogen atom, a methyl group, an ethyl group and a phenyl group are particularly preferred.

a and b each represents a mol percent, and a takes 0 to 99 and b takes 1 to 100, and a and b being freely selected depending upon properties desired for the polymers.

The polymers of general formula (I) can be synthesized generally by reacting a polymer containing a carboxyl group or a sulfinic acid residue in the side chain thereof with a compound represented by:

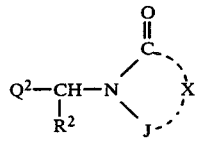

wherein J, X and $R^2$ are as described in general formula (I) and $Q^2$ represents —OH, —Br or —Cl, in the presence of an appropriate base or condensing agent. For example, the polymer of general formula (I) can be synthesized by the reaction of a polymer represented by general formula (II) with a compound represented by general formula (III) described below, in which the reaction mode is similar to the synthesis of ethylenically unsaturated monomers shown by general formula (IV) described below.

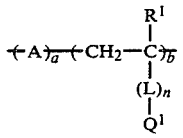

(II)

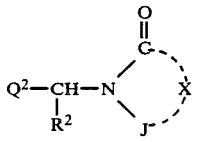

(III)

wherein A, J, X, L, n, $R^1$, $R^2$, a and b are the same as defined in general formula (I); $Q^1$ represents —COOH or —$SO_2H$; $Q^2$ represents —OH, —Br or —Cl when $Q^1$ represents —COOH; and $Q^2$ represents —Br or —Cl when $Q^1$ represents —$SO_2H$.

Preferred polymers represented by general formula (I) are obtained generally by copolymerizing the aforesaid ethylenically unsaturated monomers A and ethylenically unsaturated monomers represented by the following general formula (IV):

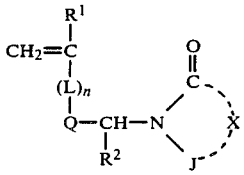

(IV)

wherein J, X, Q, L, n, $R^1$ and $R^2$ are the same as defined in general formula (I).

Among the ethylenically unsaturated monomers represented by general formula (IV), preferred monomers include but are not limited to the following:

Monomer 1

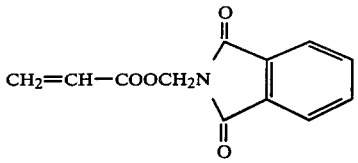

Monomer 2

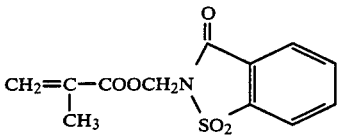

Monomer 3

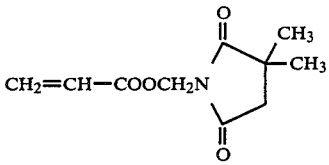

Monomer 4

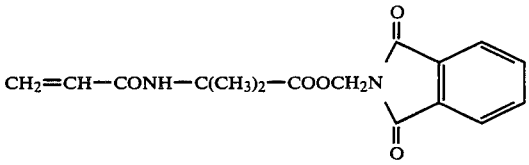

Monomer 5

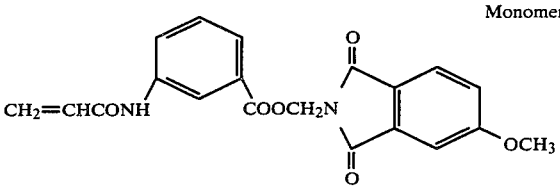

Monomer 6

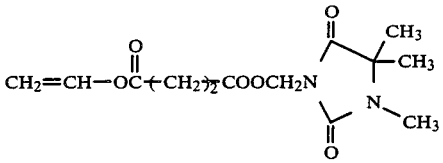

Monomer 7

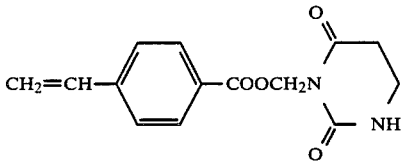

Monomer 8

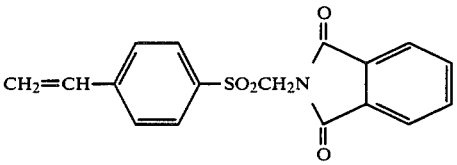

-continued

Monomer 9

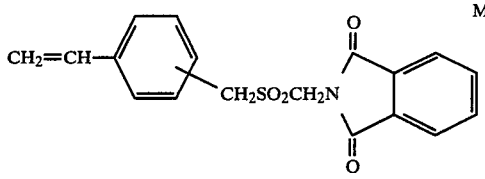

The compounds represented by the general formula (I) can be synthesized by, for example, the following reaction schemes.

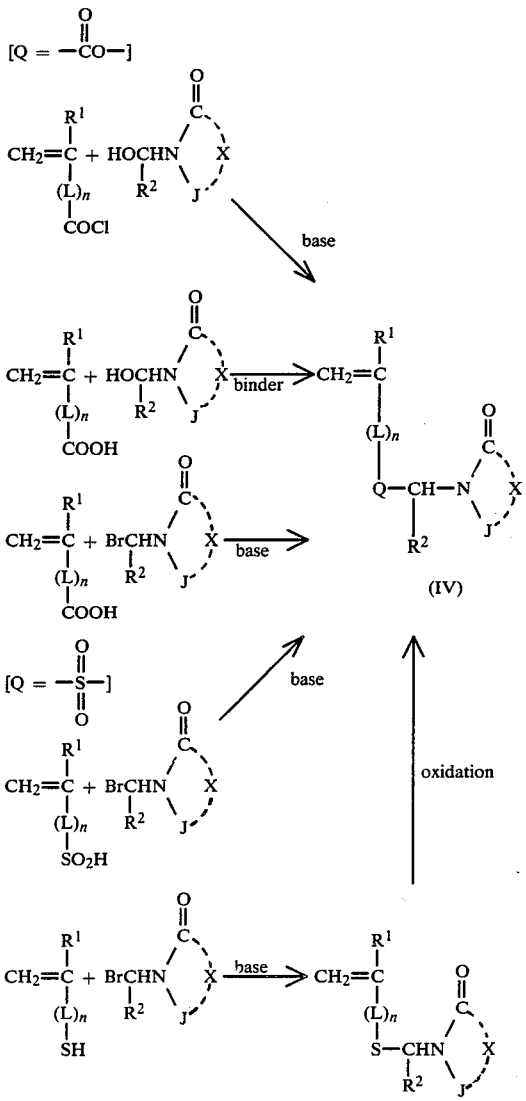

With respect to some of the monomers as described above, specific synthesis examples are given below.

SYNTHESIS EXAMPLE 1

Synthesis of Monomer 1

55 ml of acrylic chloride and 100 g of N-methylolphthalimide were mixed with 400 ml of tetrahydrofuran, and 116 ml of diisopropyl ethylamine was added dropwise to the mixture with stirring over one hour while maintaining the inside temperature at 5° to 7° C. with ice cooling. The stirring was continued for an additional 3 hours, and the reaction solution was thrown into 2 l of an ice-cooled 5% acetic acid aqueous solution, whereby crystals were formed. The crystals were collected by filtration and air dried over one night, followed by recrystallizing from 2.5 l of ethanol containing 5 g of hydroquinone monomethyl ether to obtain a title compound. Yield: 95 g (68% of the theoretical value), m.p.: 135°-138° C. The structure of the compound was confirmed by NMR spectrum and IR spectrum.

SYNTHESIS EXAMPLE 2

Synthesis of Monomer 3

To 300 ml of a methylene chloride solution containing 200 ml of acrylic acid, 46.9 g of N-methyloldimethanedione and 0.5 g of 4-dimethylaminopyridine was added dropwise 300 ml of a methylene chloride solution containing 62 g of N,N'-dicyclohexyl carbodiimide with stirring over 30 minutes while maintaining the inside temperature at 5° to 7° C. with ice cooling. After returning the temperature to room temperature, the stirring was carried out for 3 hours, whereby the formation of crystals was found. After filtering out the crystals, the mother liquor was concentrated under reduced pressure. To the remaining oily liquid was added 3 g of Irganox 1010 (a product of Ciba Geigy AG), and the mixture was subjected to distillation under reduced pressure to obtain a titled compound. Yield: 35 g (56% of the theoretical value), b.p.: 190°-200° C./1 mmHg. The structure of the compound was confirmed by NMR spectrum and IR spectrum.

SYNTHESIS EXAMPLE 3

Synthesis of Monomer 8

A mixture of 10 g of N-bromomethylphthalimide, 8.6 g of styrene sulfinic acid potassium, 0.1 ml of nitrobenzene, 2 ml of acetic acid, and 240 ml of ethanol was stirred for 3 hours while heating at 70° C. After standing to cool to room temperature, crystals formed were collected by filtration. The crystals were dried to obtain a titled compound. Yield: 4.9 g (36% of the theoretical value), m.p.: 209°-210° C. The structure of the compound was confirmed by NMR spectrum and IR spectrum.

The polymerization of the ethylenically unsaturated monomers A and the ethylenically unsaturated monomers represented by the general formula (IV) can be accomplished by generally known radical copolymerization methods which are described in detail by, for example, T. Ohtsu and M. Kinoshita, *Kobunshi Gosei No Jikkenho* (Experimental Method for Synthesis of Polymer), pp 125-154 (1972), published by Kagaku Dojin K. K. One polymerization example is given below.

SYNTHESIS EXAMPLE 4

Synthesis of Poly-(N-acryloyloxymethylphthalimide-co-acrylic acid-co-methyl methacrylate)

Into a reactor were charged 50 ml of methyl ethyl ketone, 3.0 g of acrylic acid (made by Toa Gosei Chemical Industrial Co., Ltd.), and 24.0 g of methyl methacrylate (made by Mitsubishi Gas Chemical Co., Ltd.), and the reactor was purged with a nitrogen gas. 0.22 g of 2,2'-azobis(2,4-dimethyl valeronitrile) was added thereto, and the mixture was stirred for 3 hours upon heating at 65° C. Then, 0.15 g of 2,2'-azobis(2,4-dimethyl valeronitrile) was further added thereto, and the stirring was continued for 3 hours upon heating. Thus the reaction solution became a colorless, transparent viscous solution. The resulting reaction solution was returned to room temperature and added to 600 ml of hexane while stirring, whereby a white polymer was formed. The polymer was collected by filtration and dried under reduced presence at room temperature for 6 hours to obtain a titled compound. Yield: 28 g, $[\eta]=0.124$ (at 30° C. in an ethyl acetate solution).

Other polymers which can be employed for the first timing layer are disclosed in, for example, U.S. Pat. Nos. 4,297,431, 4,288,523, 4,201,587 and 4,229,516; Japanese Patent Application (OPI) Nos. 121438/80, 166212/81, 41490/80, 54341/80, 102852/81, 141644/82, 173834/82 and 179841/82; West German Patent Application (OLS) No. 2,910,271; European Patent EP 31957 Al, and *Research Disclosure,* No. 18452.

Specific examples of preferred polymers for the first timing layer include copolymers (1) to (15) described below using the monomers described above (but not limited thereto), with (1) to (3) being particularly preferred.

(1) monomer 1/methyl methacrylate/acrylic acid copolymer (molar ratio, 6/80/14)
(2) monomer 1/methyl methacrylate/acrylic acid copolymer (molar ratio, 9/77/14)
(3) monomer 1/methyl methacrylate/acrylic acid copolymer (molar ratio, 12/74/14)
(4) monomer 3/methyl methacrylate/acrylic acid copolymer (molar ratio, 3/83/14)
(5) monomer 3/methyl methacrylate/acrylic acid copolymer (molar ratio, 5/81/14)
(6) monomer 3/methyl methacrylate/acrylic acid copolymer (molar ratio, 8/78/14)
(7) monomer 8/methyl methacrylate/acrylic acid copolymer (molar ratio, 3/83/14)
(8) monomer 8/methyl methacrylate/acrylic acid copolymer (molar ratio, 5/81/14)
(9) monomer 8/methyl methacrylate/acrylic acid copolymer (molar ratio, 7/79/14)
(10) monomer 1/butyl acrylate/acrylic acid copolymer (molar ratio, 6/80/14)
(11) monomer 4/ethyl methacrylate/acrylic acid copolymer (molar ratio, 7/82/11)
(12) monomer 8/methyl methacrylate/butyl acrylate/acrylic acid copolymer (molar ratio, 4/40/43/13)
(13) monomer 4/diacetoneacrylamide/acrylamide copolymer (molar ratio, 10/75/15)
(14) monomer 7/styrene/acrylic acid copolymer (molar ratio, 10/85/5)
(15) monomer 1/diacetoneacrylamide/acrylic acid copolymer (molar ratio, 10/88/2)

Any polymer that can be used for the first timing layer can also be employed as the polymer for the second timing layer. Other polymers can also be used for the first timing layer and the second timing layer, in addition to the polymers represented by general formula (I) and the specific polymers exemplified above, for example, polymers that reduce alkali permeability such as gelatin, polyvinyl alcohol, partially acetalized polyvinyl alcohol, cellulose derivatives (e.g., cellulose acetate), partially hydrolyzed polyvinyl acetate,; latex polymers which enhance activation energy for alkali permeability, obtained by copolymerizing a small quantity of hydrophilic comonomers such as acrylic acid monomer,; and polymers containing a lactone ring.

Of these polymers, particularly preferred are cellulose acetate disclosed in Japanese Patent Application (OPI) No. 136328/79, U.S. Pat. Nos. 4,267,262, 4,009,030 and 4,029,849,; latex polymers obtained by copolymerizing a small quantity of hydrophilic comonomers such as acrylic acid, etc. disclosed in Japanese Patent Application (OPI) Nos. 128335/79, 69629/81 and 6843/82; U.S. Pat. Nos. 4,056,394, 4,061,496, 4,199,362, 4,250,243, 4,256,827 and 4,268,604; polymers containing a lactone ring disclosed in U.S. Pat. No. 4,229,516; other polymers disclosed in Japanese Patent Application (OPI) Nos. 25735/81, 97346/81 and 6842/82; and European Patents EP No. 31,957 Al, No. 37,724 Al and No. 48,412 Al.

In addition, polymers described in the following patents and other publications can also be employed.

U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431; West German Patent Application (OLS) Nos. 1,622,936 and 2,162,277; and *Research Disclosure,* 15,162, No. 151 (1976).

The polymers used in the first and second timing layers can be used alone or in a combination of two or more polymers. Further, the polymers for the first and second timing layers may also be used in combination with polymers described in Japanese Patent Application (OPI) Nos. 1309026/79, 54341/80, 25735/81, 173834/82 and 179841/82; U.S. Pat. Nos. 4,029,849, 4,267,262 and 4,229,516; and European Patent EP No. 9795 A2.

Specific examples of polymers described in these patents and publications include vinylidene chloride copolymers, conjugated diene copolymers, and maleic acid copolymers.

In the case of combination use of the polymers for the first and second timing layers with other polymers, the mixing ratio thereof can be appropriately chosen and there is no particular limitation.

Further it is also possible to incorporate in the first or second timing layer, for example, development retarders and/or precursors thereof disclosed in U.S. Pat. No. 4,009,029; West German Patent Application (OLS) Nos. 2,913,164 and 3,014,672; and Japanese Patent Application (OPI) Nos. 155837/79 and 138745/80; hydroquinone precursors disclosed in U.S. Pat. No. 4,201,578; or other photographic additives or precursors thereof.

Conventional acidic substances can be used for the neutralizing layer and auxiliary neutralizing layer, without particular limitation.

Preferred acidic substances are substances containing an acidic group having a pKa less than 9 (or a precursor group which gives such an acidic group by hydrolysis). More preferred examples include higher fatty acids such as oleic acid described in U.S. Pat. No. 2,983,606; polymers of acrylic acid, methacrylic acid or maleic acid and partial esters or acid anhydrides thereof as disclosed in U.S. Pat. No. 3,362,819; copolymers of acrylic acid and acrylic acid esters as disclosed in French Patent No. 2,290,699; and latex-type acidic polymers as disclosed in U.S. Pat. No. 4,139,383 and *Research Disclosure,* No. 16, 102 (1977).

Other acidic substances disclosed in U.S. Pat. No. 4,088,493 and Japanese Patent Application (OPI) Nos. 153739/77, 1023/78, 4540/78, 4541/78 and 4542/78, may also be employed.

Specific examples of acidic polymers include copolymers of vinyl monomers such as ethylene, vinyl acetate, vinyl methyl ether, etc. and maleic anhydride, an n-butyl half esters thereof; copolymers of butyl acrylate and acrylic acid; and cellulose acetate hydrogen phthalate.

The photographic element of the present invention may be a light-sensitive material containing the neutralizing system or a cover sheet having the neutralizing system laminated on the light-sensitive material. Alternatively, the photographic element of the present invention may be an image-receiving material containing the neutralizing system; a unit wherein an image-receiving element, a light-sensitive element, a cover sheet containing the neutralizing system and a processing element are integrated, or a unit wherein an image-receiving element having the neutralizing system, a light-sensitive element and a processing element are integrated. In the case of a film unit comprising photographic elements being integrated as such, the film unit may or may not be stripped off after processing.

For reproduction of natural color by the color subtractive system, light-sensitive materials comprising at least two of silver halide emulsion having selectively spectral sensitivity to certain wavelength regions, e.g., blue, green and red, and a dye image forming compound having selectively spectral absorptions at the aforesaid wavelength regions (hereafter referred to as "color forming material") (or color-forming material containing a group for forming such a dye) in combination are employed.

When the photographic element of the present invention is a light-sensitive material or a film unit, it is particularly advantageous to include light-sensitive elements comprising the combination of a blue sensitive silver halide emulsion and a yellow color-forming material, the combination of a green sensitive silver halide emulsion and a magenta color-forming material and the combination of red sensitive silver halide emulsion and a cyan color-forming material. The combination unit of these emulsions and color-forming materials may be coated by laminating thereon in a sheet from in a face-to-face relation, or, they may be mixed in a granular from having color-forming material and silver halide grains present in the same grain and coated as a single layer.

The color-forming materials which are preferably employed in the present invention are substantially immobile under alkaline processing conditions and are DRR (dye releasing redox) compounds generally represented by the following equation:

(Ballast)—(Redox Cleavage Atomic Group)—(Dye)

wherein (Ballast) is a group for substantially immobilizing the compound under alkaline processing conditions but, when the moiety (Redox Cleavage Atomic Group-)—(Dye) is substantially immobile under alkaline conditions, the (Ballast) group is unnecessary. (Dye) is a dye moiety or its precursor which when split off from the compound, can move into the light sensitive element under alkaline processing conditions. (Redox-Cleavage Atomic Group) is a group that is cleaved by oxidation or reduction under alkaline conditions.

Examples of the redox cleavage atomic groups include those described in Published Allowed U.S. Application USB No. 351,673; U.S. Pat. No. 3,928,312; Japanese Patent Application (OPI) No. 50,736/78; U.S. Pat. Nos. 4,055,428, 4,053,312 and 4,336,322; Japanese Patent Application (OPI) Nos. 104343/76, 46730/78 and 130,122/79; U.S. Pat. Nos. 3,443,930, 3,443,939, 3,628,952, 3,844,785, 3,443,943, 3,980,479 and 4,278,750; Japanese Patent Application (OPI) No. 110827/78; and U.S. Pat. Nos. 4,278,750, 4,139,379, 4,218,368, 4,183,753, 4,142,891, 3,421,964 and 4,199,355.

The dyes released from the color-forming materials used in the present invention may be known dyes or dye precursors which can be converted into dyes in photographic processing steps or additional processing steps. The final image dyes may or may not be metal-chelated. Representative examples of dye structures of the color-forming materials which are useful in the present invention include metal-chelated or non-metal-chelated dyes of azo dyes, azomethine dyes, anthraquinone dyes and phthalocyanine dyes. Of these, cyan, magenta and yellow dyes are particularly important.

Examples of yellow dyes useful in the present invention include dyes described in U.S. Pat. Nos. 3,597,200, 3,309,199, 4,013,633, 4,245,028, 4,156,609, 4,139,383, 4,195,992, 4,148,641 and 4,148,643; Japanese Patent Application (OPI) Nos. 114930/76, 16130/81 and 71072/81; and *Research Disclosure,* 17630 (1978) and ibid., 16475 (1977).

Examples of magenta dyes useful in the present invention include dyes described in U.S. Pat. Nos. 3,453,107, 3,544,545, 3,932,380, 3,931,144, 3,932,308, 3,954,476, 4,233,237, 4,255,509, 4,250,246, 4,141,891, 4,207,104 and 4,287,292; and Japanese Patent Application (OPI) Nos. 106727/77, 23628/78, 36804/80, 73057/81, 71060/81 and 134/80.

Examples of cyan dyes useful in the present invention include dyes described in U.S. Pat. Nos. 3,482,972, 3,929,760, 4,013,635, 4,268,625, 4,171,220, 4,242,435, 4,142,891, 4,195,994, 4,147,544 and 4,148,642; British Patent No. 1,551,138; Japanese Patent Application (OPI) Nos. 99431/79, 8827/77, 47823/78, 143323/78, 99431/79 and 71061/81; European Pat. Nos. 53,037 and 53,040; and *Research Disclosure,* 17,630 (1978), ibid., 16,475 (1975) and ibid., 16,475 (1977).

Further dyes containing a dye moiety in which light absorption is temporarily shifted in a light-sensitive element are also useful as a dye precursor in the present invention.

The color-forming materials that are particularly useful in the present invention are negative working DRR compounds which release dyes upon oxidation under alkaline conditions. Other couplers which release diffusible dyes, such as the couplers described in U.S. Pat. No. 3,227,550 and dye developers may also be employed.

In photographic emulsions used in the present invention, any of silver bromide, silver iodobromide, silver iodochlorobromide, silver chlorobromide and silver chloride may be employed. Preferred silver halides include silver bromide, silver iodobromide and silver iodochlorobromide in which an iodide content is not greater than 20 mol% and a chloride content is not greater than 30 mol%. Particularly preferred is silver iodobromide in which an iodide content is 2 to 15 mol%.

The silver halide emulsion used may be an internal latent image type emulsion in which latent images are formed inside silver halide grains. Direct reversal photographic emulsions for forming direct positive images by a combination of internal latent image type emulsions with nucleating agents are preferred.

Internal latent image type silver halide emulsions can be clearly defined by the fact that the maximum density achieved when developing these emulsions using an "internal" type developer is greater than the maximum density achieved in the case of developing with a "surface type" developer. In the internal latent image type emulsion in the present invention, the maximum density measured by a conventional method for measuring photographic density when the silver halide emulsion, which is coated on a transparent support and exposed to light for a determined time period of 0.01 to 1 second, is developed at 20° C. for 3 minutes with Developer A (internal type developer) described below is at least 5 times greater than the maximum density obtained in the case of developing with Developer B (surface type developer) described below, at 20° C. for 4 minutes, when the silver halide emulsion is exposed as described above.

| | |
|---|---|
| Developer A: | |
| Hydroquinone | 15 g |
| Monomethyl-p-aminophenol sesquisulfate | 15 g |
| Sodium sulfate | 50 g |
| Potassium bromide | 10 g |
| Sodium hydroxide | 25 g |
| Sodium thiosulfate | 20 g |
| Water to make | 1 liter |
| Developer B: | |
| p-Oxyphenylglycine | 10 g |
| Sodium carbonate | 100 g |
| Water to make | 1 liter |

The internal latent image type silver halide emulsion which can be employed in the present invention is a hydrophilic colloidal dispersion of silver chloride, silver bromide, silver chlorobromide, silver iodobromide, silver chloroiodobromide or a mixture thereof. The halogen composition is chosen depending upon the intended use of the light-sensitive materials and processing conditions but particularly preferred is silver bromide, silver iodobromide or silver chloroiodobromide having an iodide content of not greater than 10 mole% and a chloride content of not greater than 30 mol%. Specific examples of the emulsion include, in addition to the emulsion described in U.S. Pat. No. 2,592,250, conversion type emulsions, core/shell type emulsions, and metal-doped emulsions, described in British Pat. No. 1,027,146; U.S. Pat. Nos. 3,206,313, 3,511,662, 3,447,927, 3,737,313, 3,761,276 and 3,935,014, but are not limited thereto.

Various photographic supports can be employed for the photographic element of the present invention.

In the case that the photographic element of the present invention is an image-receiving material or a film unit, the photographic element contains at least a mordanting layer (an image-receiving layer) in the image-receiving element. It is preferred that this mordanting layer comprises a polymeric mordanting agent. As polymeric mordanting agents, polymers containing a secondary or tertiary amino group, polymers containing a nitrogen-containing heterocyclic moiety, polymers of quaternary cationic groups thereof, may be employed; of these, polymers having a molecular weight of 5,000 or more are preferred and particularly preferred are polymers having a molecular weight of 10,000 or more, determined by the vapor pressure osmosis method.

Specific examples of polymeric mordanting agents include vinylpyridine polymers and vinylpyridinium cationic polymers disclosed in U.S. Pat. Nos. 2,548,564, 2,484,430, 3,148,061 and 3,756,814; vinylimidazolium cationic polymers disclosed in U.S. Pat. No. 4,123,386; polymeric mordanting agents capable of cross linking with gelatin, etc. disclosed in U.S. Pat. Nos. 3,625,694, 3,859,096 and 4,128,538, and British Pat. No. 1,227,453, aqueous sol type mordanting agents disclosed in U.S. Pat. Nos. 3,958,995, 2,721,852 and 2,798,063, Japanese Patent Application (OPI) Nos. 115228/79, 145529/79, 126027/79, 155835/79 and 17352/81; water-insoluble mordanting agents disclosed in U.S. Pat. No. 3,898,088; reactive mordanting agents which can be covalently bonded to dyes, disclosed in U.S. Pat. Nos. 4,168,976 and 4,201,840; further mordanting agents disclosed in U.S. Pat. Nos. 3,709,690, 3,788,855, 3,642,482, 3,488,706, 3,557,066, 3,271,147 and 3,271,148, Japanese Patent Application (OPI) Nos. 30328/78, 155528/77, 125/78, 1024/78 and 107835/78, and British Pat. No. 2,064,802.

In addition, mordanting agents described in U.S. Pat. Nos. 2,675,316 and 2,882,156 can be employed.

In an image-receiving layer which mordants azo dyes having a chelating group, it is preferred that polymers capable of immobilizing transition metal ions and transition metal ions be incorporated in the mordanting layer or in a layer adjacent thereto. Examples of such polymers capable of immobilizing transition metal ions are described in Japanese Patent Application (OPI) Nos. 48210/80 and 129346/80, U.S. Pat. Nos. 4,273,853, 4,282,305, 4,193,796, 4,288,511 and 4,241,163.

As processing compositions which are used to process the light-sensitive material of the present invention, basic compositions having a pH of about 9 or more and containing bases such as sodium hydroxide, potassium hydroxide, sodium carbonate, or sodium phosphate are appropriate. These compositions preferably have a pH of 11.5 or more and may contain anti-oxidants such as sodium sulfite, ascorbic acid salt, piperidinohexose reductone, etc., or silver ion concentration controllers such as potassium bromide. In addition, they may contain a tackifier such as hydroxyethyl cellulose, sodium carboxymethyl cellulose, etc.

The alkaline processing composition may further contain compounds capable of accelerating development or accelerating diffusion of dyes, for example, benzyl alcohol.

Developing agents may be incorporated in the processing compositions or incorporated at least partly into an appropriate layer (e.g., silver halide emulsion layers, layers containing color-forming materials, interlayers, image-receiving layers, etc.) of the light-sensitive materials (or film unit).

Specific examples of such developing agents include hydroquinone compounds, e.g., hydroquinone, 2,5-dichlorohydroquinone and 2-chlorohydroquinone; aminophenol compounds, e.g., 4-aminophenol, N-methylaminophenol, 3-methyl-4-aminophenol and 3,5-dibromoaminophenol; catechol compounds, e.g., catechol, 4-cyclohexylcatechol, 3-methoxycatechol and 4-(N-octadecylamino)catechol; phenylenediamine compounds, e.g., N,N-diethyl-p-phenylenediamine, 3-methyl-N,N-diethyl-p-phenylenediamine, 3-methoxy-N-ethyl-N-ethoxy-p-phenylenediamine and N,N,N',N'-tetramethyl-p-phenylenediamine; 3-pyrazolidone compounds, e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-4-methyl-4-hydroxymethyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(m-chlorophenyl)-4-methyl-3-pyrazolidone, 1-(p-chlorophenyl)-4-methyl-3-pyrazolidone, 1-(m-chlorophenyl)-3-pyrazolidone, 1-(p-chlorophenyl)-3-pyrazolidone, 1-(p-tolyl)-4-methyl-3-pyrazolidone, 1-(o-tolyl)-4-methyl-3-pyrazolidone, 1-(p-tolyl)-3-pyrazolidone, 1-(m-tolyl)-4,4-dimethyl-3-pyrazolidone, 1-(2-trifluoroethyl)-4,4-dimethyl-3-pyrazolidone and 5-methyl-3-pyrazolidone. Among them, 3-pyrazolidone compounds are preferred.

Various developing agents can be used in combination as disclosed in U.S. Pat. No. 3,039,869.

The invention is described in greater detail with reference to the following examples, but the present invention should not be construed as being limited thereto. Unless otherwise indicated, all percents, parts and ratios are by weight.

EXAMPLE 1

Cover Sheet

Three cover sheets (1, 2 and 3) in accordance with the present invention were prepared by coating the following layers (1) to (4), in this order, onto a polyethylene terephthalate transparent support.

(1) neutralizing layer prepared by coating 11 g/m$^2$ of an acrylic acid-butyl acrylate (weight ratio 8:2) copolymer having a mean molecular weight of 50,000 as determined by vapor pressure osmosis method and 0.22 g/m$^2$ of 1,4-bis(2,3-epoxypropoxy)butane;

(2) second timing layer prepared by coating 4.5 g/m$^2$ of cellulose acetate having an acetylation degree of 51.0% and an alternate copolymer of methyl vinyl ether and monomethyl maleate in a weight ratio of 95:5, having a mean molecular weight of about 10,000 as determined by the vapor pressure osmosis method;

(3) auxiliary neutralizing layer prepared by coating 3.6 g/m$^2$ of an acrylic acid-butyl acrylate (weight ratio, 8:2) copolymer having a mean molecular weight of 50,000 as determined by the vapor pressure osmosis method; and (4) first timing layer prepared by coating 4 g/m$^2$ of Copolymers (1) to (3) described above, respectively and 2.6 mol/m$^2$ of 5-(2-cyano-1-methylethylthio)-1-phenyltetrazole.

For purposes of comparison, only Layers (1) and (4) described above were coated in this order to prepare 3 Cover Sheets (1', 2' and 3').

Light-Sensitive Sheet

Each of the following layers was coated onto a polyethylene terephthalate transparent support in the following sequence to prepare a light-sensitive sheet.

(1) mordanting layer prepared by coating 3.0 g/m$^2$ of gelatin and 3.0 g/m$^2$ of a polymer latex mordanting agent.

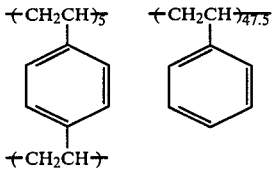

-continued

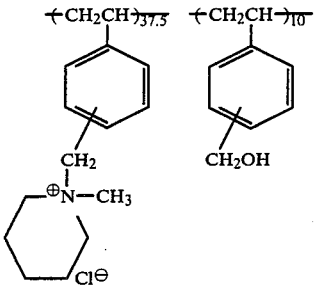

(2) white reflecting layer prepared by coating 18 g/m$^2$ of titanium dioxide and 2.0 g/m$^2$ of gelatin.

(3) light-shielding layer prepared by coating 2.0 g/m$^2$ of carbon black and 1.0 g/m$^2$ of gelatin.

(4) layer prepared by coating 0.44 g/m$^2$ of the following cyan dye releasing redox compound, 0.09 g/m$^2$ of tricyclohexyl phosphate, 0.008 g/m$^2$ of 2,5-di-t-pentadecylhydroquinone and 0.8 g/m$^2$ of gelatin.

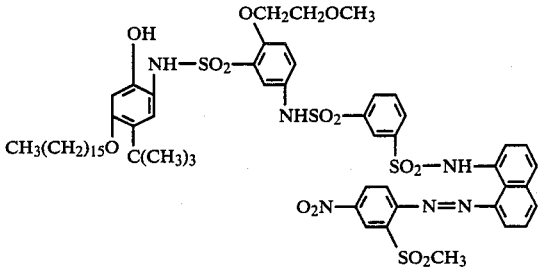

(5) red sensitive emulsion layer prepared by coating a red sensitive internal latent image type direct positive silver bromide emulsion (1.03 g/m$^2$ as the amount of silver), 1.2 g/m$^2$ of gelatin, 0.04 mg/m$^2$ of the following nucleating agent and 0.13 g/m$^2$ of 2-sulfo-5-n-pentadecylhydroquinone sodium salt.

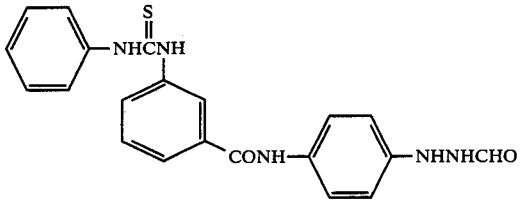

(6) layer prepared by coating 0.43 g/m$^2$ of 2,5-di-t-pentadecylhydroquinone, 0.1 g/m$^2$ of trihexyl phosphate and 0.4 g/m$^2$ of gelatin.

(7) layer prepared by coating a magenta dye releasing redox compound of formula (A) below (0.21 g/m$^2$), a magenta dye releasing redox compound of formula (B) (0.11 g/m$^2$), tricylohexyl phosphate (0.08 g/m$^2$), 2,5-di-t-pentadecylhydroquinone (0.009 g/m$^2$) and gelatin (0.9 g/m$^2$).

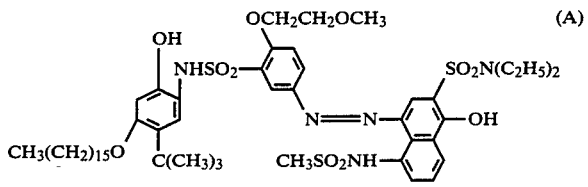

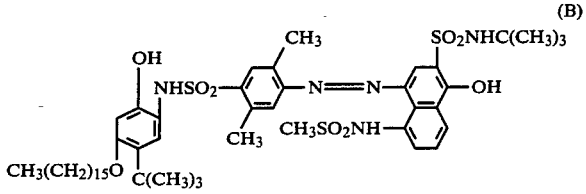

(8) green sensitive emulsion layer prepared by coating a green sensitive internal latent image type direct positive silver bromide emulsion (0.82 g/m$^2$ as the amount of silver), gelatin (0.9 g/m$^2$), the same nucleating agent as in Layer (5) (0.03 mg/m$^2$) and 2-sulfo-5-n-pentadecylhydroquinone sodium salt (0.08 g/m$^2$).

(9) same layer as Layer (6)

(10) layer prepared by coating a yellow dye releasing redox compound of the following formula (0.53 g/m$^2$), tricyclohexyl phosphate (0.13 g/m$^2$), 2,5-di-t-pentadecylhydroquinone (0.014 g/m$^2$) and gelatin (0.7 g/m$^2$).

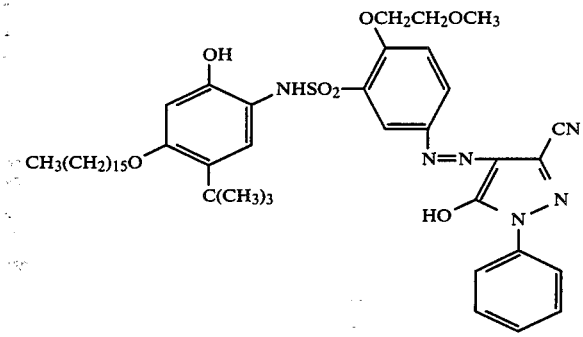

(11) blue sensitive emulsion layer prepared by coating a blue sensitive internal latent image type direct positive silver bromide emulsion (1.09 g/m$^2$ as the amount of silver), gelatin (1.1 g/m$^2$), the same nucleating agent as in Layer (5) (0.04 mg/m$^2$) and 2-sulfo-5-n-pentadecylhydroquinone sodium salt (0.07 g/m$^2$)

(12) layer containing 1.0 g/m$^2$ of gelatin

The above light-sensitive sheet was exposed to light through a color test chart. Thereafter Cover Sheets (1 through 3) of the present invention and Cover Sheets (1' through 3') for comparison were superimposed on the exposed light-sensitive sheet, respectively and the following processing solution was spread between both sheets at 25° C. in a thickness of 85 μm (the development was performed by the assistance of a pressing roller).

| Processihg Solution: | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |

-continued

| | |
|---|---|
| Carboxymethyl cellulose Na salt | 58 g |
| Potassium hydroxide (28% aqueous solution) | 200 cc |
| Benzyl alcohol | 1.5 cc |
| Carbon black | 150 g |
| Water | 685 cc |

Red, green and blue densities of the images formed 1 hour after the spreading were measured. After preserving in dark for 14 days at room temperatures, the densities of the images were measured again. The difference (Δ Dmax) in maximum density (Dmax) between 14 days after and 1 hour after was made a measure of post-transfer. The results shown in Table 1 were obtained.

TABLE 1

| | Data on Post-Transfer | | | |
|---|---|---|---|---|
| | Neutralizing Timing* | ΔDmax | | |
| Cover Sheet | (minutes) | B | G | R |
| 1 (Invention) | 2.0 | 0.13 | 0.15 | 0.09 |
| 2 (Invention) | 3.7 | 0.10 | 0.08 | 0.04 |
| 3 (Invention) | 5.0 | 0.08 | 0.09 | 0.06 |
| 1' (Comparison) | 1.3 | 0.44 | 0.62 | 0.41 |
| 2' (Comparison) | 3.2 | 0.17 | 0.22 | 0.18 |
| 3' (Comparison) | 4.8 | 0.14 | 0.12 | 0.10 |

*Value showing a rate of pH reduction in processing solution which is calculated from reduction of blue density of thymol phthalein when a thymol phthalein indicator sheet is superimposed on cover sheet and an alkaline processing solution is spread therebetween. This value is parallel to sharpness of transferred image, i.e., the shorter the timing, the better the sharpness, and used as a measure for evaluating sharpness.

In Table 1, as is obviously seen from the comprison between the values of Cover Sheets 1 and 1', 2 and 2'and 3 and 3', Δ Dmax is decreased using the cover sheets of the present invention as compared to the comparison cover sheets, showing that post-transfer is markedly prevented in the present invention. Further, the neutralizing timing when using the cover sheets of the present invention is almost equivalent to the case when using the comparison cover sheets; this means that sharpness of transferred images is not seriously deteriorated as compared to the case of using conventional cover sheets. From the values in Table 1, it is clear that when the cover sheets of the present invention are used, post-transfer can be markedly prevented without deteriorating sharpness, as compared to the case of using conventional cover sheets.

EXAMPLE 2

Cover Sheets were prepared having the same layer construction as in Example 1 except that the coated amount in the auxiliary neutralizing layer was changed in Cover Sheets 1, 2 and 3 as follows:

Cover Sheets 1'', 2'' and 3'' coated amount: 7.2 g/m$^2$ (Invention).

Cover Sheets 1''', 2''' and 3''' coated amount: 0 (Comparison).

Image densities were measured in a manner similar to Example 1 using the same light-sensitive sheet and processing solution. The results shown in Table 2 were obtained by comparing the minimum density (Dmin) 1 hour after and 4 days after the processing and calculating the difference Δ Dmin between.

TABLE 2

| | Neutralizing Timing (minutes) | Dmin | | | ΔDmin | | |
|---|---|---|---|---|---|---|---|
| | | B | G | R | B | G | R |
| 1 (3.6) | 2.0 | 0.31 | 0.26 | 0.39 | 0.06 | 0.04 | 0.06 |
| 1" (7.2) | 2.0 | 0.28 | 0.24 | 0.37 | 0.05 | 0.02 | 0.03 |
| 1''' (0) | 4.9 | 0.31 | 0.27 | 0.41 | 0.06 | 0.04 | 0.06 |
| 2 (3.6) | 3.7 | 0.32 | 0.29 | 0.42 | 0.07 | 0.03 | 0.04 |
| 2" (7.2) | 3.5 | 0.30 | 0.27 | 0.41 | 0.06 | 0.02 | 0.03 |
| 2''' (0) | 4.9 | 0.33 | 0.31 | 0.43 | 0.07 | 0.03 | 0.03 |
| 3 (3.6) | 5.0 | 0.32 | 0.29 | 0.46 | 0.06 | 0.02 | 0.04 |
| 3" (7.2) | 4.5 | 0.32 | 0.30 | 0.43 | 0.05 | 0.02 | 0.04 |
| 3''' (0) | 4.8 | 0.34 | 0.31 | 0.45 | 0.07 | 0.02 | 0.04 |

*coated amount in auxiliary neutralizing layer

The results indicate that Dmin and Δ Dmin decrease as the coated amount of the auxiliary neutralizing layer increases from 0 to 3.6 to 7.2 g/m$^2$, and the provision of the auxiliary neutralizing layer is useful both for prevention of post-transfer and reduction in Dmin (reduction in fog).

When comparing the coated amounts 0 and 3.6 g/m$^2$ with the neutralizing timing value, the neutralizing timing time is considerably longer and sharpness is inferior when the coated amount is 0.

EXAMPLE 3

Comparison Cover Sheets were prepared by coating the following Layers (1) to (3) in this order onto a polyethylene terephthalate transparent support.

(1) neutralizing layer prepared by coating a copolymer (11 g/m$^2$) of acrylic acid and butyl acrylate in 80:20 (weight ratio) and 1,4-bis-(2,3-epoxypropoxy)butane (0.22 g/m$^2$).

(2) second timing layer prepared by coating acetyl cellulose (4.3 g/m$^2$) (100 g of acetyl cellulose is hydrolyzed to form 36.6 g of acetyl groups) and a methanol-ring opened product (0.23 g/m$^2$) of 60:40 (weight ratio) copolymer (i.e., a copolymer of styrene and monomethyl maleate) (molecular weight of about 50,000 as determined by the vapor osmosis method) of styrene and maleic anhydride as well as 2.6 mmol/m$^2$ of 5-(2-cyano-1-methylthio)-1-phenyltetrazole.

(3) first timing layer prepared by coating a mixture of 49.7:42.3:3:5 copolymer latex of styrene/n-butyl acrylate/acrylic acid/N-methylolacrylamide and 93:4:3 (weight ratio) copolymer latex of methyl methacrylate acrylic acid/N-methylolacrylamide as a 6:4 mixture of the former latex and the latter latex as the solids content, in a thickness of 2 μm.

After exposing the light-sensitive sheet prepared in Example 1 to light through a fine line test chart for sharpness evaluation, the aforesaid cover sheets for comparison and Cover Sheet No. 1 of the present invention prepared in Example 1 were superimposed on the light-sensitive sheet, respectively. The processing solution of Example 1 was spread between both sheets at 25° C. in a thickness of 85 μm. After standing for 1 day, sharpness was measured through a green filter using a microdensitometer. The space frequency at which C.T.F. (Cyclic Transfer Function) was 0.5 is shown in Table 3.

TABLE 3

| Cover Sheet | Space Frequence at which C.T.F. is 0.5 (c/mm) |
|---|---|
| Comparison | 3.0 |
| 1 (Invention) | 3.4 |

From the results in Table 3, sharpness is superior when using the cover sheet of the present invention, as compared to the comparison cover sheet.

EXAMPLE 4

Cover sheets in accordance with the present invention were prepared by coating the following Layers (1) to (5), in this order, onto a polyethylene terephthalate transparent support.

Layers (1) to (3): same as Layers (1) to (3) for cover sheet as in Example 1.

(4) first timing layer prepared by coating 4.5 g/m$^2$ of cellulose acetate having an acetylation degree of 51.0% and an alternate copolymer of methyl vinyl ether and monomethyl maleate in a weight ratio of 95:5 and 2.6 mmol/m$^2$ of 5-(2-cyano-1-methylethylthio)-1-phenyltetrazole (a layer containing mainly cellulose acetate).

(5) first timing layer prepared by coating a mixture of 49.7:42.3:3:5 copolymer latex of styrene/n-butyl acrylate/acrylic acid/N-methylolacrylamide and 93:4:3 (weight ratio) copolymer latex of methyl methacrylate/acrylic acid/N-methylolacrylamide as a 6:4 mixture of the former latex and the latter latex as the solids content, in a thickness of 2 μm.

The two light-sensitive sheets prepared in Example 1 were provided, and one was exposed to light through a color test chart and the other through a fine line test chart for sharpness evaluation. Thereafter, the cover sheets were superimposed on the respective light-sensitive sheets, and the processing solution of Example 1 was spread between the both sheets. The sharpness and density change were then measured in the same manner as in Example 1. As the result, it was confirmed that post-transfer can be effectively prevented without deteriorating sharpness, as compared to the case of using conventional cover sheets.

While the invention has been described in detail and with reference to specific embodiments thereof, it will be apparent from one skilled in the art that various changes and modifications can be made therein without departing from the spirit and scope thereof.

What is claimed is:

1. A photographic element for color diffusion transfer comprising a neutralization system for reducing pH of an alkaline processing solution, comprising:

an element comprising an integral laminate film unit comprising (1) a light-sensitive sheet comprising a support having coated thereon, in succession, an image-receiving element and a light-sensitive element containing at least one silver halide emulsion layer in association with a dye image-providing compound; (2) a cover sheet comprising a neutralization system and (3) a processing element comprising an alkaline processing solution capable of being spread between said light-sensitive elements and said cover sheet to develop and transfer an image;

wherein said neutralizing system comprises a neutralization layer, an auxiliary neutralization layer and one or two timing layers;

wherein the alkaline processing solution reaches said neutralization layer and said auxiliary neutralization layer through at least one timing layer;

wherein neutralization of said processing solution in said neutralization system is divided into at least two steps in such a manner that:

in the first step the pH of said processing solution is reduced in said auxiliary neutralization layer to a range in which development and dye release reactions are substantially discontinued, but in which diffusion of a dye for forming transfer images continues, and in the second step, the pH of said processing solution is further reduced in said neutralization layer at a rate lower than in the first step to a final pH in which the transfer image formed is stabilized; and wherein when two timing layers are present, said neutralization system is coated on a support and comprises, in succession, said neutralizing layer, a second timing layer said auxiliary neutralizing layer and a first timing layer wherein said first timing layer has a positive temperature coefficient.

2. The photographic element of claim 1 wherein at least a neutralizing layer, a second timing layer, an auxiliary neutralizing layer and a first timing layer are coated onto a support.

3. The photographic element of claim 1 wherein said first timing layer permits rapid permeation of said processing solution after acting as a barrier to permeation for a certain period of time.

4. The photographic element of claim 3 wherein said first timing layer comprises a polymer represented by general formula (I):

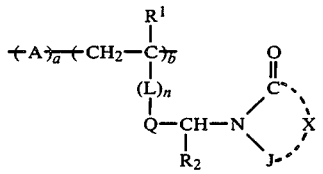

(I)

wherein A is a monomer unit derived from a monomor containing at least one copolymerizable ethylenically unsaturated group; $R^1$ is a hydrogen atom or a methyl group; L is a divalent organic group; Q is —COO— or —$SO_2$—; $R^2$ is a hydrogen atom, an alkyl group, or an aryl group; J is —CO— or —$SO_2$—; X is an atomic group necessary to complete at least one 5 or 6-membered heterocyclic ring which is unsubstituted or substituted, or which is a fused ring system thereof; n is 0 or 1; and a and b each represents a mol percent, and a takes 0 to 99 and b takes 1 to 100.

5. The photographic element of claim 2 wherein said second timing layer permits permeation of said processing solution at a rate of permeation which is lower than the rate of permeation permitted by said first timing layer.

6. The photographic element of claim 5 wherein said second timing layer contains a cellulose derivative.

7. The photographic element of claim 1 wherein the element (1) is stripped off from the element (2).

8. The photographic element of claim 1 wherein said dye image providing compound is contained in a layer adjacent to said photographic emulsion layer.

9. The photographic element of claim 1 wherein said dye image providing compound is a compound which releases a diffusible dye upon oxidation with the oxidation product of a developing agent.

10. The photographic element of claim 1 wherein said photographic emulsion is a direct reversal photographic emulsion.

11. The photographic element of claim 10 wherein said direct reversal photographic emulsion is an internal latent image direct reversl photographic emulsion.

12. The photographic element of claim 11 wherein the internal latent image type emulsion is a core/shell internal latent image emulsion.

13. A photographic element for color diffusion transfer comprising a neutralization system for reducing pH of an alkaline processing solution, comprising:

an element comprising an integral laminate film unit comprising (1) a light-sensitive sheet comprising a support having coated thereon a light-sensitive element containing at least one silver halide emulsion layer in association with a dye image-providing compound, (2) an image-receiving element comprising a neutralization system and (3) a processing element comprising an alkaline processing solution capable of being spread between said light-sensitive elements and said image-receiving element to develop and transfer an image;

wherein said neutralizing system comprises a neutralization layer, an auxiliary neutralizing layer and one or two timing layers;

wherein the alkaline processing solution reaches said neutralization layer and said auxiliary neutralization layer through at least one timing layer;

wherein neutralization of said processing solution in said neutralization system is divided into at least two steps in such a manner that:

in the first step the pH of said processing solution is reduced in said auxiliary neutralization layer to a range in which development and dye release reactions are substantially discontinued, but in which diffusion of a dye for forming transfer images continues, and in the second step, the pH of said processing solution is further reduced in said neutralization layer at a rate lower than in the first step to a final pH in which the transfer image formed is stabilized; and wherein when two timing layers are present, said neutralization system is coated on a support and comprises, in succession, said neutralizing layer, a second timing layer, said auxiliary neutralizing layer and a first timing layer wherein said first timing layer has a positive temperature coefficient.

14. The photographic element of claim 13, wherein at least a neutralizing layer, a second timing layer, an auxiliary neutralizing layer and a first timing layer are coated onto said support.

15. The photographic element of claim 13, wherein said first timing layer permits rapid permeation of said processing solution after acting as a barrier to permeation for a certain period of time.

16. The photographic element of claim 15, wherein a said first timing layer comprises a polymer represented by general formula (I):

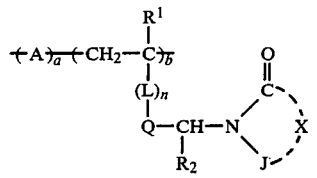

(I)

wherein A is a monomer unit derived from a monomer containing at least one copolymerizable ethyleneically unsaturated group; $R^1$ is a hydrogen atom or a methyl group; L is a divalent group, Q is —COO— or $SO_2$—; $R^2$ is a hydrogen atom, an alkyl group, or an aryl group; J is —CO— or —$SO_2$—; X is an atomic group necessary to complete at least one 5- or 6-membered heterocyclic ring which is unsubstituted or substituted, or which is a fused ring system thereof, n is 0 or 1; and a and b each represents a mol percent, and a takes 0 to 99 and b represents 1 to 100.

17. The photographic element of claim 14, wherein said second timing layer permits permeation of said processing solution at a rate of permeation which is lower than the rate of permeation permitted by said first timing layer.

18. The photographic element of claim 17, wherein said second timing layer contains a cellulose derivative.

19. The photographic element of claim 13, wherein said dye image-providing compound is contained in a layer adjacent to said photographic emulsion layer.

20. The photographic element of claim 13, wheein said dye image-providing compound is a compound which releases a diffusible dye upon oxidation with the oxidation product of a developing agent.

21. The photographic element of claim 13, wherein said photographic emulsion is a direct reversal photographic emulsion.

22. The photographic element of claim 21, wherein said direct reversal photographic emulsion is an internal latent image direct reversal photographic emulsion.

23. The photographic element of claim 22, wherein the internal latent type image emulsion is a core/shell internal latent image emulsion.

* * * * *